United States Patent [19]

Darling

[11] 4,379,656

[45] Apr. 12, 1983

[54] BUOYANCY CONTROL VALVE FOR SCUBA DIVING VESTS

[76] Inventor: Phillip H. Darling, 15711 Williams #173, Tustin, Calif. 92680

[21] Appl. No.: 968,625

[22] Filed: Dec. 11, 1978

Related U.S. Application Data

[63] Continuation of Ser. No. 815,735, Jul. 14, 1977, abandoned, which is a continuation-in-part of Ser. No. 691,658, Jun. 1, 1976, abandoned.

[51] Int. Cl.[3] ..... B63C 11/02

[52] U.S. Cl. ..... 405/186; 128/204.24; 128/205.24; 128/205.25; 128/207.12; 137/505.11; 137/888; 441/96

[58] Field of Search ..... 137/505.11, 888; 405/186; 128/204.24, 205.24, 205.25; 441/90, 92, 96, 118; 128/207.12

[56] References Cited

U.S. PATENT DOCUMENTS

| | | | |
|---|---|---|---|
| 3,147,499 | 9/1964 | Nelson et al. | 9/313 |
| 3,338,266 | 8/1967 | Zilka et al. | 137/604 |
| 3,436,777 | 4/1969 | Greenwood | 9/313 |
| 3,485,243 | 12/1969 | Bird et al. | 128/145.8 |
| 3,515,502 | 6/1970 | Coordes | 137/604 X |
| 3,717,147 | 2/1973 | Flynn | 128/145.8 |
| 3,727,250 | 4/1973 | Koehn et al. | 9/313 |
| 3,747,139 | 7/1973 | Braly | 9/313 |
| 4,045,835 | 9/1977 | Flam et al. | 9/313 |

*Primary Examiner*—Sherman D. Basinger
*Attorney, Agent, or Firm*—Knobbe, Martens

[57] ABSTRACT

A buoyancy control valve connected to a source of gas under pressure and to the buoyancy control vest of a scuba diver permits, through the manipulation of a pair of actuators, the use of the energy within the compressed air to forcibly exhaust air from the scuba diver's vest to effect a rapid deflation of the vest. In addition, the same valve permits application of the pressurized air to the vest for inflating the vest and also permits deflation of the vest using pressure differentials without forced assistance from the pressurized air source. Included within the same valve is a pressure differential responsive relief valve which opens in response to excessive pressure within the diver's vest to prevent overinflation of pressurized air to a breathing mask and a forcible exhausting of air from the same breathing mask through the manipulation of a pair of actuators so that an unconscious person or animal may be alternately forced to inhale and exhale for resuscitation. In this use the relief valve is also important since it assures that the person or animal is not injured by high pressure gas entering his lungs and also gives a visual indication when the lungs are full.

33 Claims, 10 Drawing Figures

FIG. 1.
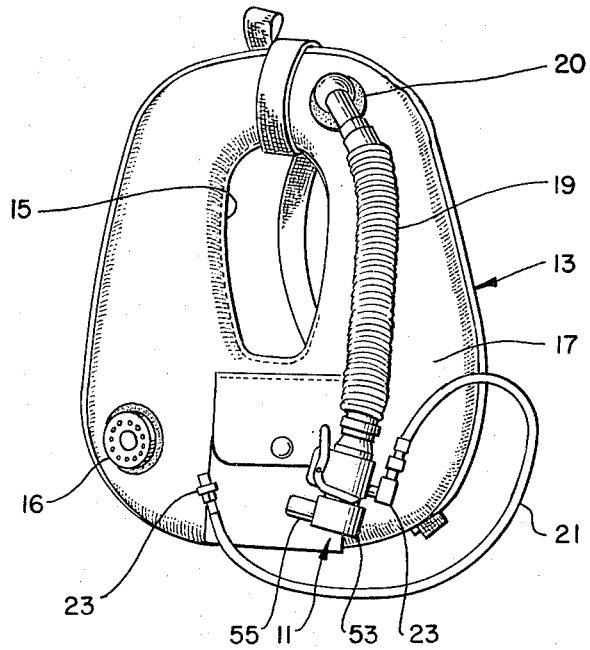
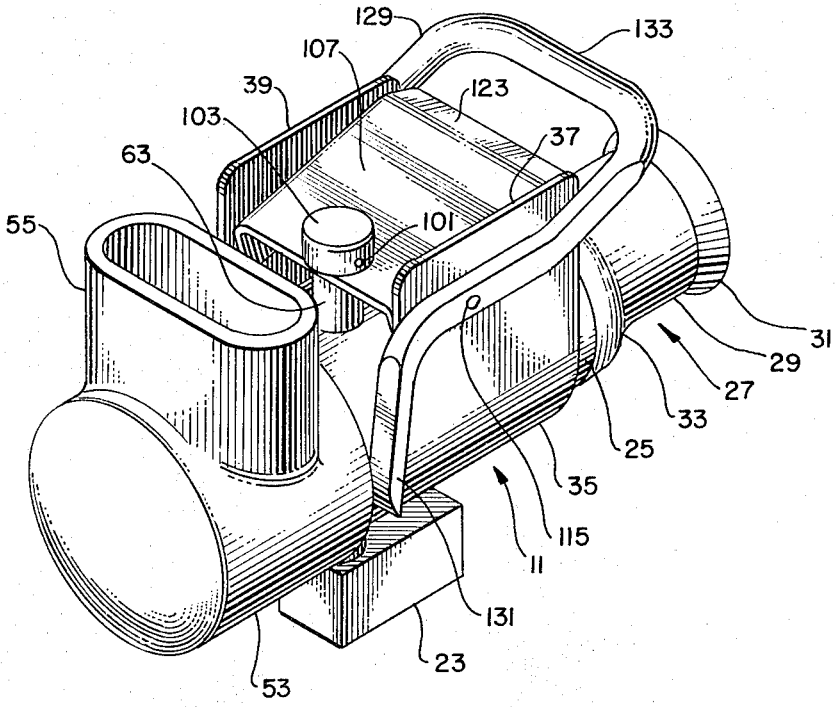
FIG. 2.

BUOYANCY CONTROL VALVE FOR SCUBA DIVING VESTS

This is a continuation of Ser. No. 816,735 filed July 14, 1977 and now abandoned and which is a continuation-in-part of Ser. No. 691,658 filed June 1, 1976 and also now abandoned.

BACKGROUND OF THE INVENTION

This invention relates to scuba diving apparatus, and more particularly to buoyancy control vests worn by scuba divers and an apparatus for control of the amount of air in such vests for adjusting the buoyancy of a scuba diver to meet various conditions which he encounters.

It has been common in the prior art to provide divers with vests having one or more inflatable reservoirs which may be inflated either by mouth, by using the diver's breathing air supply, or by another pressurized gas supply carried by the diver. Such vests are used for adjusting the buoyancy of the diver for various purposes. Initially, a diver may wish to swim on the water surface with the vest substantially inflated to lend positive buoyancy and thus facilitate such swimming. When the diver reaches a location where he wishes to submerge, he will at least partially deflate his buoyancy control vest, preferably to achieve either neutral buoyancy or negative buoyancy, possibly with the assistance of a weighted belt, until he has submerged to the depth at which he wishes to swim. He may then wish to reinflate his vest slightly to achieve neutral buoyancy. In some circumstances, the diver may need to adjust the amount of air in his buoyancy control vest as he changes the depth at which he is swimming in order to maintain neutral buoyancy.

It has been common in the prior art to utilize the diver's breathing air, available from a high pressure cylinder through a regulator which reduces the air pressure to less than 200 pounds per square inch. This air has typically been admitted by a special valve in the prior art, typically situated on the diver's chest. Alternatively, the prior art has permitted oral inflation of such vests.

The prior art has not, however, satisfactorily solved the problem of deflation of such vests. It has been common in the prior art to require a diver to open a valve directly venting the buoyancy vest to the surrounding water. The vest will, of course, not properly vent unless the tube leading from the vest to the vent valve is elevated to a position above the vest. Common procedure in the past has therefore been to have the diver roll on his back to position the vent tube at an elevation above the buoyancy control vest, or to detach the valve from a harness and raise it in his hand above the level of the vest. In this configuration, the pressure of the surrounding water will force air from the vest through the vent valve. This operation is clumsy, relatively slow, and in some circumstances may even be dangerous. It is possible, if the diver positions himself incorrectly, to flood the vest with water on opening of the vent valve. Furthermore, precise control of the amount of air within the vest is impossible using this technique and air from the breathing tanks is often wasted, since more air than is necessary for neutral buoyancy may be dumped from the vest requiring reinflation to achieve neutral buoyancy.

In addition, prior art vests typically include a safety valve which prohibits the vest from becoming overinflated, possibly rupturing the vest. These valves are generally located either on the vest or, in some instances, in combination with inflation valves, usually constructed as a completely independent valve structure, substantially increasing the cost of the vest or its valve assembly.

In the field of resuscitators, it has been common in the past to have quite complex mechanisms for resuscitating unconscious persons and animals and there has been not satisfactory small, extremely portable, relatively inexpensive device for this purpose.

Some resuscitators in the past have provided for pressurized air for inflating the lungs of an injured animal or person but have permitted the resilience of the animal's chest cavity to deflate the lungs before another pressurization cycle. Such a process is substantially slower and less effective for resuscitation than is a process where the animal's lungs are forcibly deflated by the resuscitating apparatus.

SUMMARY OF THE INVENTION

The present invention alleviates these and other difficulties associated with the prior art by providing a relatively simple, compact and easy to use valve which may be used to inflate the buoyancy control vest using breathing air or any other pressurized gas supply. The valve also permits pressure differential exhausting of air from the vest, as in prior art apparatus, and additionally includes, within the same structure, a pressure relief valve to prohibit overinflation of the buoyancy control vest. The most important feature of the valve, however, is a power deflation mechanism which permits energy in the pressurized gas source to be used for forcibly exhausting air from the buoyancy control vest.

These desirable features are accomplished using a valve which is connected to the pressurized gas source and admits gas, typically breathing air, to a specially constructed fitting within an elongate tube. The tube is connected at one end to an air hose which is connected in turn to the buoyancy control vest. The remaining end of the tube includes a second valve which selectively closes this second end of the tube or vents the second end of the tube to the ambient surroundings.

The special fitting to which pressurized air is fed utilizes the Coanda effect to exhaust large quantities of gas from the buoyancy control vest toward the vented end of the tube. If this vented end is open to the ambient surroundings, gas will be drawn by the Coanda pumping action out of the vest into the ambient surroundings, forcibly deflating the buoyancy control vest. If, however, as pressurized gas is admitted through this fitting, the valve at the vent end of the tube is closed, pressurized gas will be applied directly to the buoyancy control vest to inflate the vest. Each of the two valves is independently controllable by simple lever manipulation on the valve structure. Thus, the valve at the vent end of the tube may be opened without applying pressurized gas to the device to allow a pressure differential deflation of the buoyancy control vest.

The second valve which interconnects the vent end of the tube with the surroundings is spring biased to a closed position, the spring having a predetermined amount of pretension to permit this valve to operate as a pressure relief valve for the vest. Thus, when the pressure differential between the vest and the surrounding water reaches a predetermined level, this valve will automatically open to prevent rupture of the vest. For example, when a diver has adjusted the vest for neutral buoyancy at a substantial depth and begins to surface, the water pressure surrounding the vest decreases and the gas within the vest may expand to completely fill the vest. Once the vest chamber is full, further surfacing will begin to stress the vest structure itself. At this point, as the diver approaches the surface, the pressure relief valve will automatically open to bleed air from the vest in accordance with his rate of ascent.

It has also been found that the valve of the present invention has an alternate, extremely important use as a small, portable, hand-held resuscitator for resuscitating persons and animals who are unconscious. Since, in response to air from a pressurized source, the valve of this invention can either inflate or deflate a diver's buoyancy control vest, it can also be used when attached to a breathing mask to inflate and power deflate the lungs of such an unconscious animal.

In this use the pressure relief valve is also important since it assures that the animal's lungs will not be over inflated which could injure the animal. In addition, during inflation of the animal's lungs, opening of the pressure relief valve can be used as a visual indication to the individual operating a resuscitator that the inflation cycle should be ended and a deflation cycle begun. It has also been found that during the deflation cycle, as soon as the animal's lungs are completely deflated, the sound made by the Coanda effect device within the valve of the present invention will change so that the operator is alerted that an inflation cycle should begin. Alternately, of course, a simple counting procedure for inflation and deflation cycles can be used as is common in other resuscitation practices.

The invention thus provides a simple hand-held valve which can be connected to a high pressure source of air or oxygen as well as a breathing mask and which permits a simple manipulation of a first lever to turn the device on and off and a second lever which is alternately depressed and released to forcibly inflate and deflate the lungs of the unconscious animal. The valve also permits a mouth-to-mouth resuscitation practice through the valve by deenergizing the gas supply while opening the relief valve port which includes a mouth piece for the operator.

These and other advantages of the present invention are best understood through the following detailed description which references the drawings, in which:

FIG. 1 is a perspective view of a buoyancy compensator vest to be worn around the neck of a diver and including the buoyancy compensation valve of the present invention attached by an air hose to the vest;

FIG. 2 is a perspective view of the buoyancy compensation valve of the present invention removed from the vest and connecting hoses;

and

Figure 10:
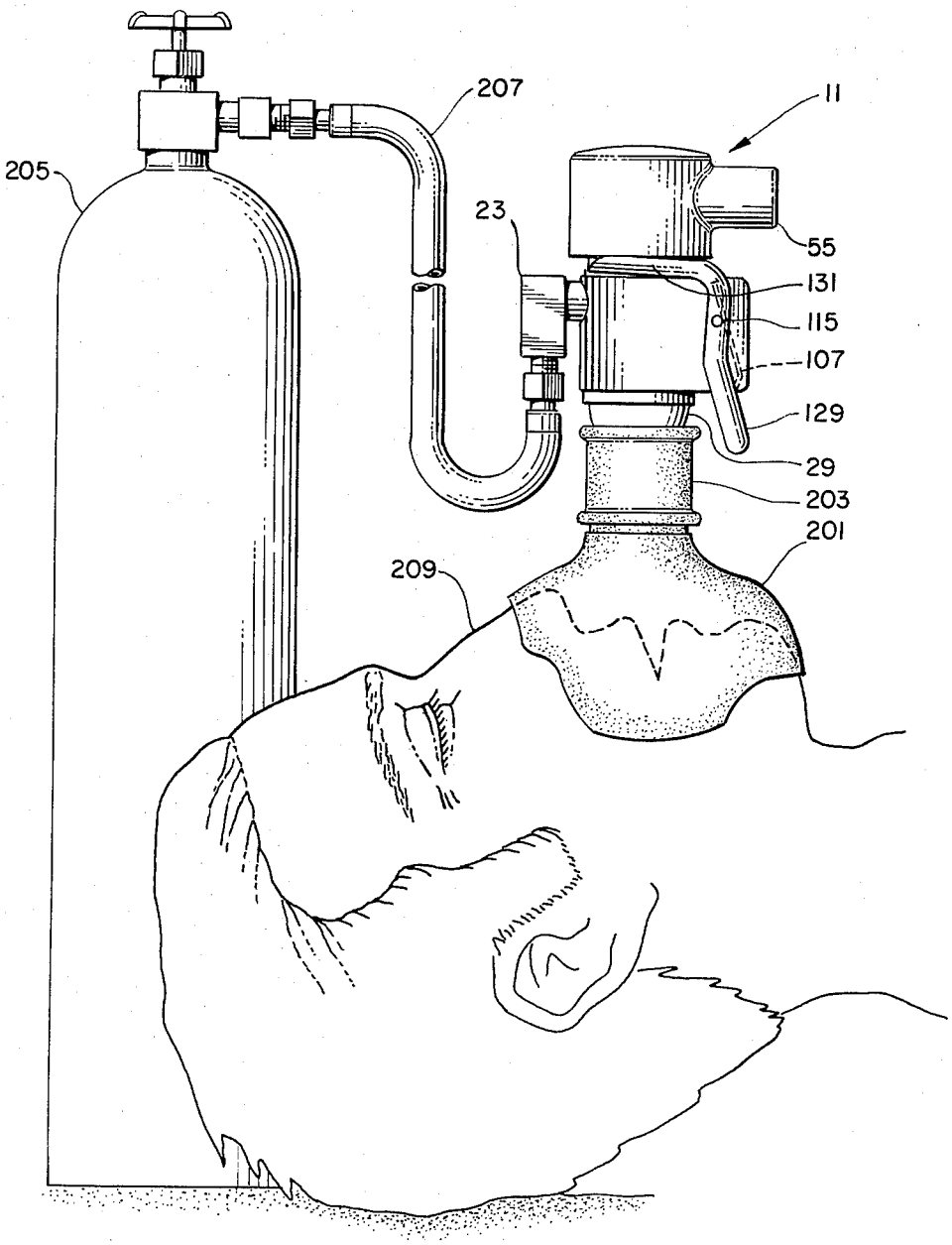

FIG. 10 is a perspective view showing the valve of the present invention interconnected between a source of pressurized gas and a breathing mask for resuscitating a person or animal.

DETAILED DESCRIPTION OF THE PREFERRED EMBODIMENT

Referring initially to FIG. 1, the valve 11 of the present invention is shown attached to a buoyancy compensation vest 13. The vest 13 is identical to those commonly used in the prior art and includes a through aperture 15 for passing over the neck of the diver so that the main buoyancy chamber 17 fits against the diver's chest. Many such prior art vests 13 include a pressure relief valve 16 to protect the vest 13 from overpressurization and rupture. As will be understood through the detailed description which follows, the relief valve 16 is not necessary on the vest 13 when used in combination with the valve 11 of the present invention.

The valve 11 is connected to the chamber 17 through a large diameter air hose 19 connected to a fitting 20 surrounding an opening in the vest 13. The air hose 19 is preferably reinforced or accordian quilted to prevent its collapse in the event that the pressure surrounding the vest exceeds the pressure within the air hose 19 as would occur, for example, during forced air dumping from the vest 13. Also connected to the valve 11 is a pressure gas supply line 21, typically connected through a fitting 23 at one end to the low pressure side of the first stage regulator in a two stage regulator system for supplying breathing air from compressed air cylinders. The pressure in the line 21 will typically be less than 200 pounds per square inch. The air hose 19, as well as the pressure line 21, are both long enough to place the valve 11 at a convenient location adjacent the diver's chest so that the valve 11 may be manipulated using one hand. In addition, as has been recognized in the prior art, the hoses 19 and 21 should either be disconnectable from the valve or sufficiently long to permit the diver to raise the valve 11 above the vest 13 to permit pressure differential deflation of the chamber 17.

Figure 3:
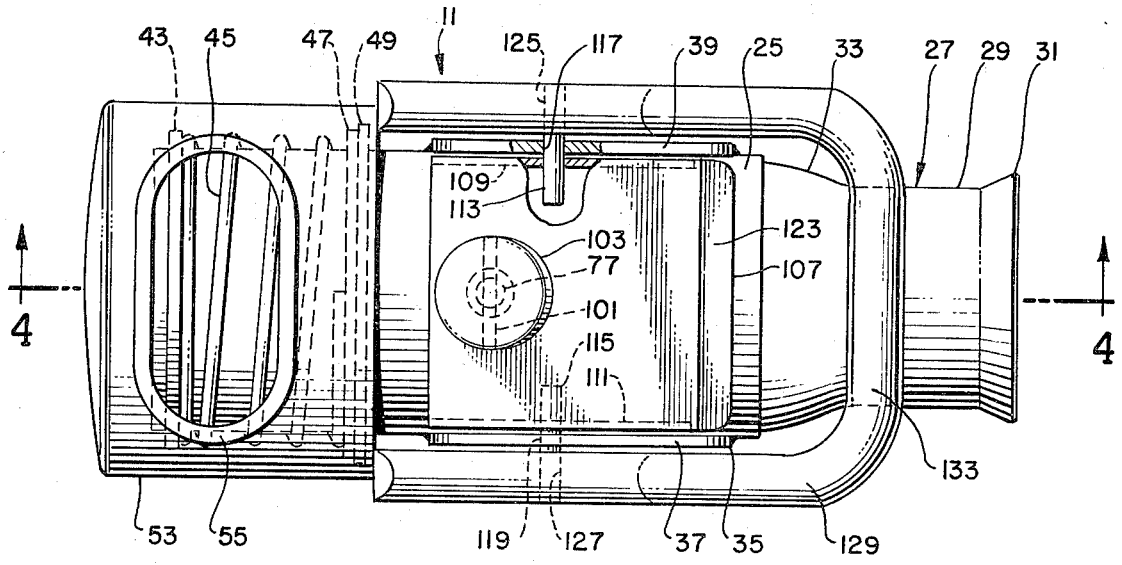
FIG. 3 is a top plan view of the compensation valve of FIG. 2, partially in section.
Figure 4:
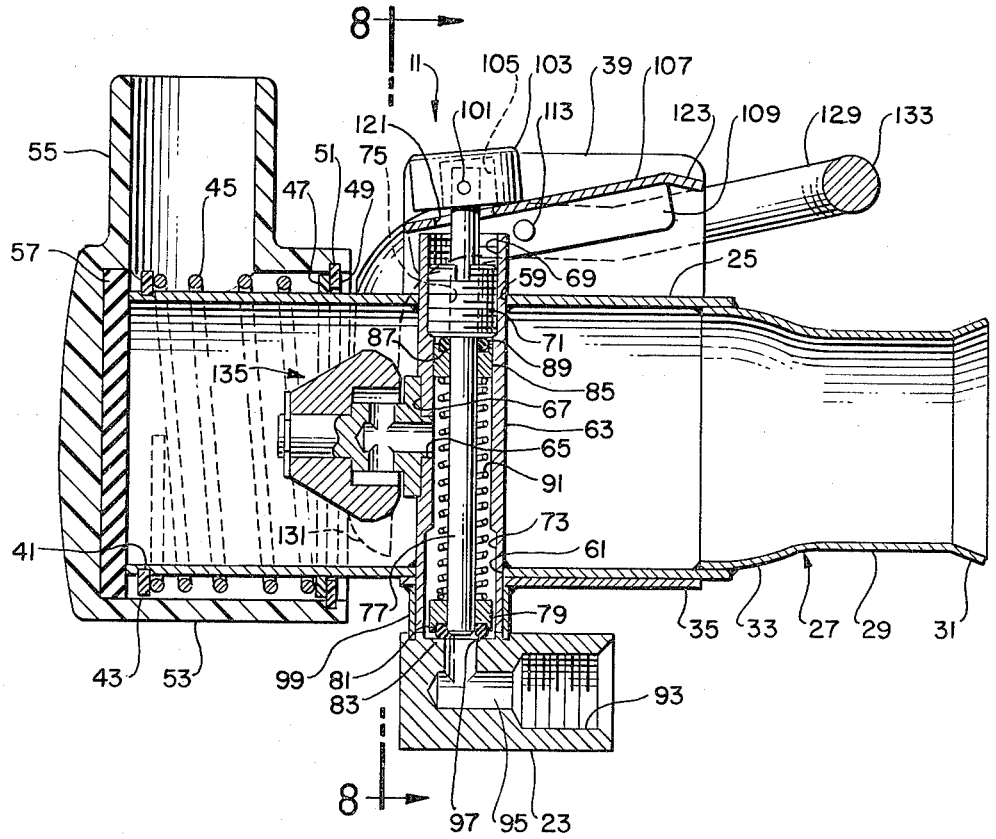
FIGS. 4, 5, 6 and 7 are sectional views of the compensation valve of the present invention, taken along lines 4—4 of FIG. 3, showing the valve in various operational modes.

Referring now to FIGS. 2, 3 and 4, the structural details of the valve 11 will be described. A main tubular valve housing 25, preferably formed of brass or other noncorroding metal or plastic, is joined and sealed at one end with a flared, tubular hose connector 27, also preferably made of noncorroding material. These elements, if brass, may be brazed together at their junction. The flared hose connector 27 preferably includes a cylindrical central section 29 unitarily formed with a pair of conical end sections 31 and 33, the end section 33 extending to a diameter which permits a tight fit within one end of the main cylindrical housing 25. The cylindrical portion 29 provides a convenient recess for positioning a hose clamp or other fixture used to connect the air hose 19 (FIG. 1) to the flared fitting 27. Both the main cylindrical housing 25 and flared fitting 27 are of relatively large diameter, typically having an inside diameter exceeding one inch, to permit relatively unrestrained flow of air or other gas to and from the chamber 17 of the vest 13.

A U-shaped bracket 35, having an internal diameter at its curved end which conforms with the external diameter of the main cylindrical housing 25, is attached to surround approximately 180° of the circumference of the main cylindrical housing 25 and to extend beyond the housing 25 opposite the curved portion to provide a pair of upstanding mounting flanges 37 and 39. This bracket 35 is typically formed of brass or other noncorroding material and may be brazed onto the main housing 25.

The end of the cylindrical housing 25 opposite the flared fitting 27 includes an annular groove 41 into which an annular ring 43 formed of Delrin, nylon or other plastic material is resiliently positioned. The nylon ring 43 has an internal diameter conforming approximately to the external diameter of the annular groove 41 so that the ring 43 may be slipped over the end of the housing 25 and retained within the groove 41. The ring 43 is relatively rigid to form a stop for a compression spring 45 having a diameter which is only slightly larger than the outside diameter of the main housing 25. The opposite end of the spring 45 is abutted against a second ring 47 formed of Delrin, nylon or other plastic material having an internal diameter closely conforming to the external diameter of the main housing 25. This ring 47 is in turn abutted against a third ring 49 formed of Delrin, nylon or other plastic material which is resiliently snapped into an annular groove 51 in the open cylindrical end of an exhaust valve cap 53. This exhaust valve cap 53 is a cup-shaped member, typically formed of relatively rigid plastic, and including an exhaust port 55, typically of oval cross section, extending from one side.

Positioned within the bottom of the cup-shaped member 53, and preferably attached thereto, as by adhesive, is a flat, circular disc-shaped valve member 57. This valve member 57 is preferably formed of elastomeric material, such as neoprene, which forms a tight seal with the end of the cylindrical housing 25 when abutted thereagainst.

It can be seen from the above description that one end of the spring 45 is held stationary in relation with the valve 11 by abutment against the nylon ring 43. The remaining end of the spring 45, through the nylon rings 47 and 49, biases the valve cap 53 to the right, as viewed in FIGS. 2, 3 and 4, biasing the valve member 57 against the open end of the main cylindrical housing 25 to close this end. Furthermore, the biased abutment of the nylon ring 47 and 49 seals the telescoping interconnection between the valve cap 53 and housing 25 to prohibit flow of water or gas between the cylindrical portion of the valve cap 53 and the external diameter of the main housing 25.

The portion of the valve apparatus 11 described thus far operates as a pressure relief valve for the vest 13 (FIG. 1). When fully extended, as shown in FIG. 4, the spring 45 has a predetermined precompression. When the pressure of gas within the compensation vest 13 exceeds the combined pressure of surrounding fluid on the end of the valve cap 53 and the precompression of the spring 45, the valve cap 53 will telescope to the left, as viewed in FIGS. 2, 3 and 4, opening the end of the main housing 25 to communication with the exhaust port 55 and permitting gas to escape from the vest 13. The precompression of the spring 45 is thus selected to maintain the valve member 57 abutted against the end of the main housing 25 unless sufficient pressure exists within the compensation vest 13 to endanger the integrity of the vest 13.

The nylon ring 43 is preferably designed to have a smaller external diameter than the internal diameter of the valve cap 53 to permit a small degree of cocking of the valve cap 53 relative the main cylindrical housing 25 to assure that the valve member 55 will fit flat against the open end of the housing 25, assuring an adequate seal when this pressure relief valve is closed.

A pair of aligned bores 59 and 61 form openings in the main cylindrical housing 25 for receipt of a tubular, pressurized gas passage 63, the bore 59 passing through the housing 25 and the bore 61 passing through both the housing 25 and U-shaped bracket 35. The tubular passage 63 is typically brazed in place in the main housing 25, and has a smooth external diameter throughout its entire length except for a lateral bore 65 communicating with the internal diameter of the tube 63 at approximately the center line of the main housing 25, and a flat 67 surrounding the bore 65.

The upper end of the internal diameter of the tube 63, as viewed in FIG. 4, is threaded at 69 to receive an externally threaded alignment and bearing member 71. The remaining end of the tube 63 has an enlarged diameter portion 73 to permit the flow of pressurized gas around the valve member described below.

The bearing member 71 includes a central bore 75 acting as a valve guide for an elongate valve stem 77. Attached to one end of the valve stem 77, as by epoxy, an annular retaining ring 79 forms an annular groove 81 for retaining an O-ring valve member 83 between the retainer 79 and stem 77. A second retaining member 85 is slidingly received on the valve stem 77 and includes an annular groove 87 for retaining an O-ring 89.

A compression spring 91, loosely fitted around the valve stem 77, biases the retainer 79 and connected valve stem 77 in a downward direction as viewed in FIG. 4, and biases the retainer 85 in an upward direction, so that the O-ring 89 is sealed against one end of the valve guide 71. The single spring 91 thus serves the dual purpose of maintaining compression on the O-ring 89 to seal the interface between the valve stem 77 and valve guide 71 and biasing the valve stem 77 and valving O-ring 83 in a downward direction.

Attached to the end of the tube 63 extending through the bracket 35 is a pressurized gas inlet fitting 23. This fitting includes a threaded inlet portion 93 for connection to the pressure line 21 (FIG. 1) and an orifice 95 leading to a valve seat 97. The fitting 23 is attached to the tube 63 and bracket 35 by an offsetting, cylindrical collar 99 brazed to the bracket 35 and to the fitting 23. The valve seat 97 is designed to be engaged by the O-ring 83 for closing the interface between the tube 63 and the orifice 95. When, however, the valve stem 77 is raised, the precompression of spring 91 having been overcome, pressurized gas will flow from the fitting 23, around the retainer 79 as permitted by the increased diameter portion 73 of the tube 63, to the bore 65 for supplying pressurized gas to the buoyancy compensation system. It will be appreciated that the valve guide 71 aligns the valve 83 with the valve seat 97.

Journalled to the opposite end of the valve stem 77 by a pin 101 is a cap member 103 including a cupped aperture 105 on one side for receipt of the end of the valve stem 77. The cap member 103 is free to rotate to a limited degree about the end of the valve stem 77 on the pin 101, the diameter of the aperture 105 being somewhat larger than the diameter of the pin 77.

This cap 103, and its attached valve stem 77, is raised to open the valve 83 by a gas inlet lever or actuator 107 formed as a generally flat plate including a pair of peripheral, normally extending flanges 109 and 111. These flanges 109, 111 include apertures for receipt of journal pins 113, 115, respectively, which pins in turn pass through aligned apertures 117 and 119 in the flanges 39 and 37, respectively. The actuator 107 includes an aperture 121 surrounding the valve stem 77 so that the actuator 107 may underlie the cap 103. Thus, the actuator 107 is free to rotate about the pins 113 and 115 and, when the free end 123 of the actuator 107 is depressed by the diver, the end of the actuator 107 including the aperture 121 will be raised, lifting the cap 103 and attached valve stem 77 to open the valve 83, overcoming the bias of spring 91, to admit pressurized gas to the compensator 11.

These same pins 113, 115 are pressed into apertures 125 and 127, respectively, in opposite sides of a dump valve lever or actuator 129. This dump valve lever 129 has a U-shaped upper portion journalled to the pins 113, 115, each side of the U extending to an offset camming arm 131. These camming arms 131 fit closely adjacent the sides of the main housing 25 to engage the open cylindrical end of the valve cap 53. Thus, when the upper extremity 133 of the actuator 129 is depressed by the diver, the actuator 129 will rotate about pins 113, 115 to engage the arms 131 with the valve cap 53, forcing the valve cap 53 to telescope to the left as viewed in FIG. 4, overcoming the precompression of the spring 45, to open the dump valve, providing a clearance between the end of the housing 25 and the valve member 57.

Figure 8:
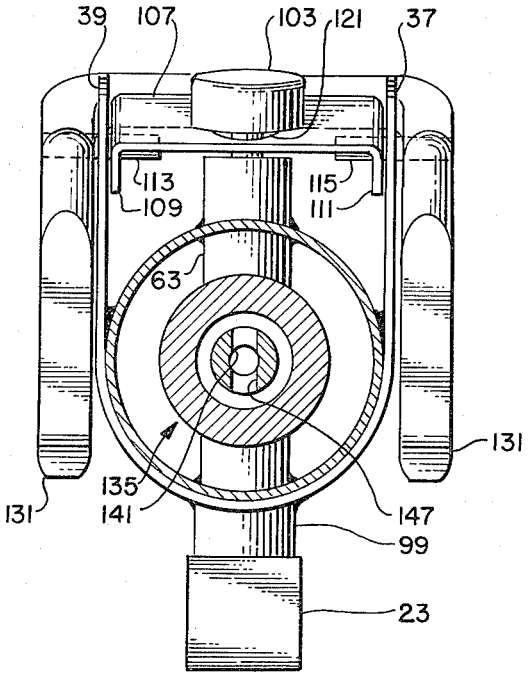
FIG. 8 is a lateral sectional view taken along lines 8—8 of FIG. 4 of the valve.
Figure 9:
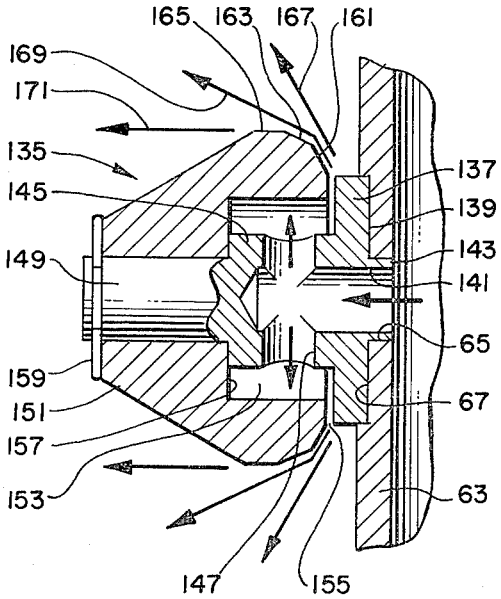
FIG. 9 is an enlarged partial sectional view taken along lines 4—4 of FIG. 3, showing the air inlet nozzle utilized for inducing the Coanda effect in the valve of the present invention.

Pressurized gas admitted to the valve 11 by depression of the actuator 107 passes through the lateral bore 65 and enters an inlet fitting 135 best shown in FIGS. 8 and 9. This fitting 135 includes a T-shaped member 137 having an enlarged flange 139 at one extremity. Thus flange 139 is attached, as by epoxy, to the flat 67 on the tube 63 and includes an aperture 141 and tubular extension 143 designed to engage the lateral bore 65 in the tube 63. The aperture 141 extends into a first tubular portion 145 of the fitting 137 in which a second aperture 147, normal to the aperture 141, communicates with the aperture 141. A second cylindrical, nonapertured portion 149 of the fitting 137 extends beyond the first cylindrical portion 145 and forms a mounting base for a conical-shaped fitting 151. The fitting 151 includes a cavity 153 surrounding the aperture 147 and providing an annular space for the admission of pressurized gas to the valve system. This annular space in turn communicates with a narrow annular gap 155 between one extremity of the fitting 151 and the flange 139. The gap 155 is preferably between five and ten thousandths of an inch in width. A shoulder 157 at one end of the cavity 153 forms a seat for abutment of the fitting 151 against the first cylindrical portion 145 of the fitting 137 to accurately provide the proper width of the gap 155. A split ring 159 may be used to hold the fittings 137 and 151 together.

The exterior surface of the fitting 151 surrounding the gap 155 is critically shaped and includes three conforming, truncated conical surface sections 161, 163 and 165. The section 165 is preferably either cylindrical or only slightly conical in shape. Gas exiting from the annular chamber 153 through the gap 155, driven by the high pressure in chamber 153, will in many instances achieve near sonic velocities as a consequence of the small width of the annular gap 155. The largest portion of this gas will cling to the surface 161, commonly known as the Coanda effect, to form a conical inrush of gas past the fitting 135. A portion of this gas, as shown by the arrow 167, will exit tangentially to the surface 161 while a second portion will cling to the surface 163 and exit tangentially to this surface as shown by the arrow 169. The remaining gas will cling to the surface 165 to exit tangentially thereto, as shown by the arrow 171. Plural exiting cones of high velocity gas will therefore be admitted by the fitting 135 when the valve 83 is open.

Figure 5:
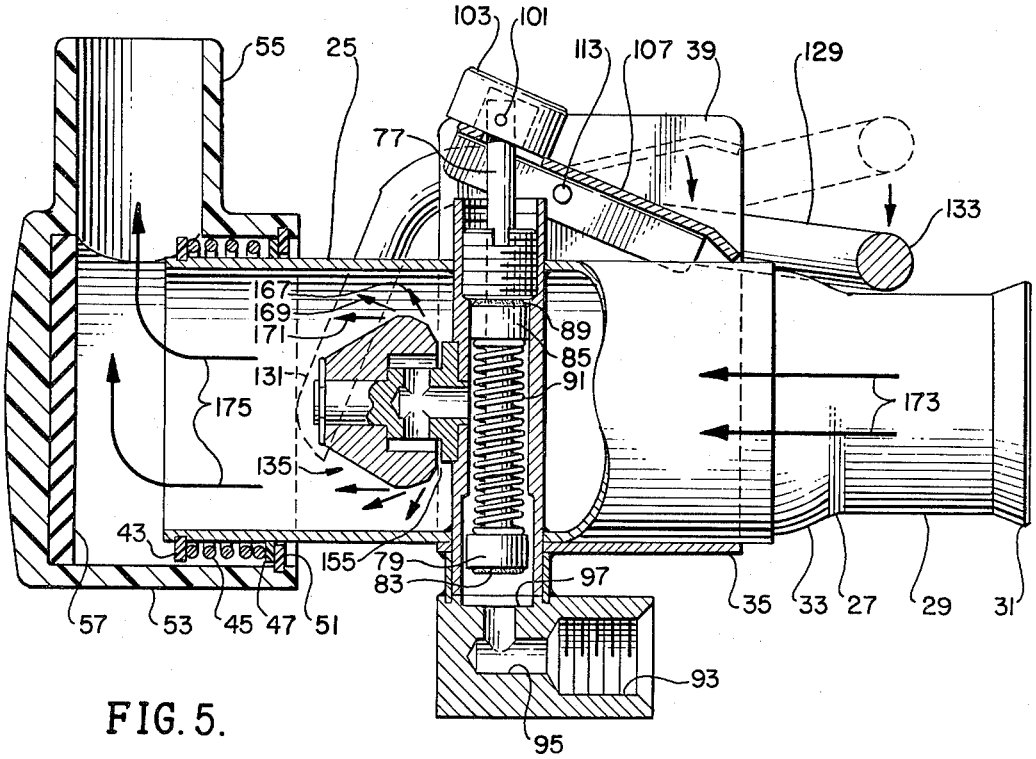

Referring to FIG. 5, this low pressure, high velocity conical flow of gas will entrain large volumes of low pressure gas within the main cylindrical housing 25, forcing this gas to the left as viewed in FIG. 5. If, when high velocity gas is admitted to the system, the end 133 of the actuator 129 is depressed so that the valve member 57 is spaced from the housing 25, large volumes of gas will be drawn toward the left as viewed in FIG. 4 and out of the exhaust port 55. It has been found that a relatively small amount of high velocity gas admitted to the system will entrain a much larger volume of low pressure gas from the diver's vest 13 and thus forcibly exhaust a large amount of gas from the diver's vest.

When high velocity gas is admitted to the system but the valve 57 is closed against the end of the housing 25, air will be entrained but cannot be exhausted from the valve 11. This air thus stagnates in the left end as viewed in FIG. 4 and the pressurized air passes through the flared fitting 29 to inflate the diver's vest 13.

Referring now to different figures, the various operational modes of the valve 11 will be described. Referring initially to FIG. 4 wherein neither of the actuators 107, 129 is depressed, no gas is admitted from the pressurized source and the valve member 57 seals the end of the housing 25 to maintain the gas within the vest 13. If, under these conditions, the pressure in the vest 13 becomes excessive, this pressure will overcome the preload of the spring 45, telescoping the valve cap 53 to open the valve 57, exhausting gas from the vest. This can happen, for example, if the diver is surfacing so that the surrounding water pressure is reduced, expanding the gas within the vest and increasing its pressure relative the surrounding water pressure. It should be noted that the surrounding water pressure bears against the valve cap 53 so that a balanced condition is always maintained by the valve 11, permitting higher pressure within the vest at lower water depths.

Referring now to FIG. 5 wherein both the actuators 107 and 129 have been simultaneously manually depressed by the diver using one hand, it can be seen that the camming arms 131 have disengaged the valve member 57 from the end of the cylindrical housing 25 and that the valve stem 77 has been raised to lift the valve 83 from the seat 97. The cap 103 rotates about the pin 101 to conform with the angle of inclination of the actuator 107. In this configuration, pressurized gas follows through the gap 155 as shown by the arrows 167, 169 and 171. This high velocity envelope of gas entrains large volumes of low pressure gas to draw gas, as shown by the arrows 173, into the housing 25, forcibly exhausting large volumes of gas from the diver's vest to rapidly deflate the vest. This entrained gas, along with the high velocity admitted gas, is passed beyond the end of the housing 25, as shown by the arrows 175, and exhausted through the exhaust port 55. Thus, when a diver with an inflated vest is swimming along the surface of the water and wishes to dive below the surface, he may simultaneously depress the actuators 107 and 129 to rapidly power deflate his vest, producing neutral or negative buoyancy for the diver. Similarly, if the diver is swimming at a particular depth and wishes to dive deeper, he may depress both of the actuators 107, 129 to exhaust a small amount of gas from his vest to reduce his buoyancy.

Figure 6:
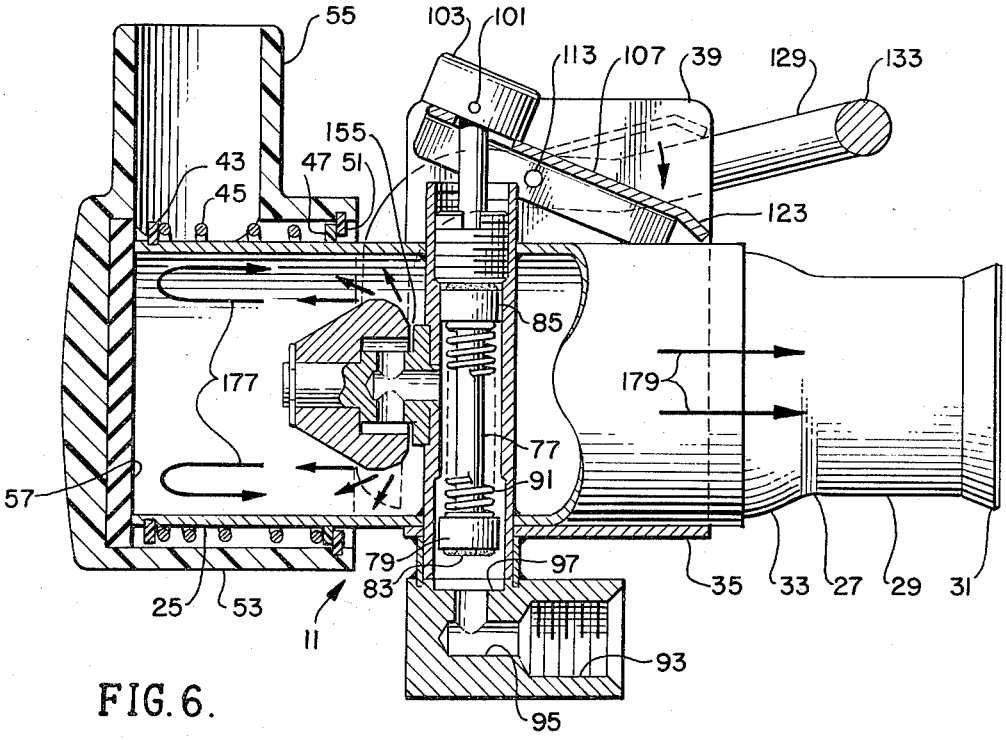

Referring now to FIG. 6, the valve 11 is shown with the actuator 129 in its normal elevated position and the actuator 107 manually depressed. In this mode, the valve 83 is raised from engagement with the seat 97 so that high velocity gas is admitted through the gap 155. This high velocity gas, along with any entrained low pressure gas, will stagnate at the closed end of the housing 25 as shown by the arrows 177, producing a gas flow 179 through the flared fitting 29 into the diver's vest 13 to inflate the vest. This will permit the diver to rapidly inflate the vest to allow him to surface or to swim at a lesser depth. If, during this operation, the diver depresses the actuator 107 for too long a period of time so that the vest is in danger of rupturing due to overpressurization, the pressure within the housing 25 will overcome the precompression of the spring 45, automatically opening the valve 57 to exhaust excess gas from the vest 13.

Figure 7:
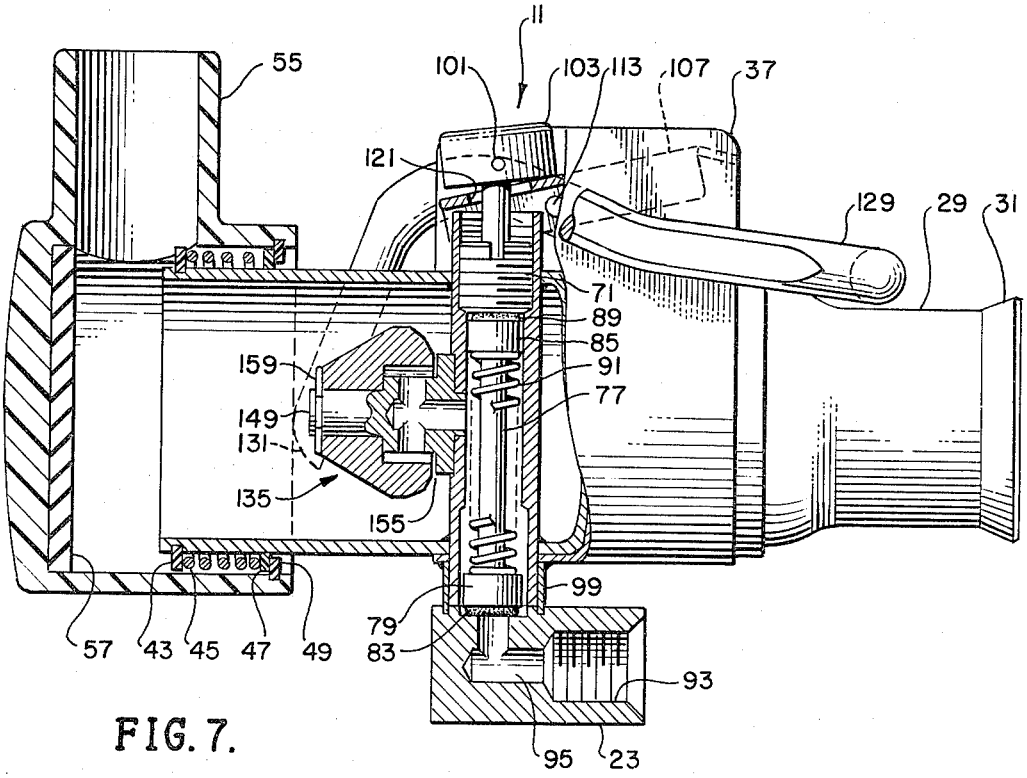

Referring now to FIG. 7, the valve 11 is shown with the actuator 129 depressed but the actuator 107 in its normal elevated position. In this mode the valve 83 is closed so that high velocity gas is not admitted to the system. The valve 57 however is open, allowing the diver to inflate the vest by blowing into the vent 55. In addition, this configuration of the valve may be used for deflating the vest 13 using pressure differential alone. Thus, if the valve 11 is elevated to a position above the vest 13 and the actuator 129 alone is depressed, water pressure surrounding the vest 13 will force gas out of the vest 13, producing a gravity dumping of gas within the vest out of the vent tube 55. This mode may therefore be used when the diver wishes to conserve as much as his pressurized gas supply as possible and it is convenient to elevate the valve 11 for dumping.

In summary, the present invention operates as a transducer to utilize the energy within pressurized gas to entrain large volumes of low pressure gas to accomplish a power deflation of the vest 13, forcibly exhausting air to permit the diver to reduce his buoyancy. At the same time this single valve structure includes a pressure relief valve unitarily formed with the dump valve structure to prevent overpressurization of the vest 13. The valve also permits open communication between the vent port 55 and vest 13 in the configuration shown in FIG. 7 to allow oral inflation or gravity deflation of the vest 13. As a final mode of operation, the valve, when used in the mode shown in FIG. 6, permits inflation of the diver's vest 13 using the pressurized gas source.

This invention contributes substantially to the diver's safety by permitting him to easily inflate and deflate his compensation vest to increase or decrease his buoyancy without adjusting his body or the vest to contorted positions. All of these advantages are nevertheless accomplished using a relatively simple mechanical device, the simplicity increasing the dependability of the structure. It has been found that the Coanda effect exhaustion of gas from the vest is extremely efficient, the high velocity gas typically entraining more than its own volume of low pressure gas. Thus, since the largest buoyancy compensation vest typically includes less than one cubic foot of compensation volume, less 1 cubic foot of high velocity gas is required for complete exhaustion of such a vest. This volume of high velocity gas is insignificant in comparison with the volume of air required for breathing, so that use of this device does not substantially reduce the amount of time which a diver is capable of remaining submerged if his breathing supply is used as the pressure gas source.

Referring now to FIG. 10, an alternate use for the valve of FIGS. 2 through 9 will be described. It must be understood, in this instance, that the valve is identical in construction with that of FIGS. 2 through 9 and only the connections at the fitting 23 for admitting pressurized gas and at the cylindrical end section 29, previously attached by hose 19 to a diver's buoyancy compensation vest 13, are changed. In this application the fitting 23 is connected to a source of either air or oxygen suitable for breathing by a person or an animal (hereinafter animal), while the cylindrical end 29 of the main tubular housing 25 is connected to a resuscitation mask 201 by a short hose 203. The pressurized air or oxygen supply will typically be in the form of a pressurized portable tank 205 connected to the fitting 23 by a high pressure hose 207.

The resuscitation mask 201, shown in FIG. 10, is intended to be any mask commonly used in prior art for assisting in the breathing of an animal, and will generally seal to the face of the animal to cover both the nose and mouth openings so that air may be forcibly applied to the animal's lungs. In this case the mask 201 is shown applied over the face of a person 209.

Operation of the valve 11 in the resuscitation application shown in FIG. 10 will now be described. When both of the levers 107 and 129 are depressed so that the valve takes the configuration of FIG. 5, the energy of the air or oxygen in the tank 205 will be used to forcibly draw air from the resuscitation mask 201 through the valve 11 and out the exhaust opening 55 to power deflate the lungs of the animal 209. When the animal's lungs are completely deflated, the Coanda effect pump will no longer be able to pump gas from the lungs of the animal 209 and the sound made by air rushing from the Coanda effect device will change so that the operator will know that the lungs of the animal 209 are completely exhausted. The operator now releases the lever 129 so that the camming arms 131 (FIG. 4) release the relief valve 57 to seal against the housing 25, and the valve takes on the configuration shown in FIG. 6 wherein air or oxygen from the tank 205 is applied under pressure to the resuscitation mask 201 and thus to the lungs of the animal 209. The animal's lungs are thus inflated but the inflation is limited by the relief valve 57 (FIG. 6) which opens when the pressure within the mask 201 is sufficient to overcome the bias of the spring 45. The relief valve 57 in this configuration thus protects the animal 209 from an over-inflation of its lungs which might injure the animal 209. Inflation of the lungs of the animal 209 will continue with the operator monitoring the relief valve 57, and watching for it to open. As soon as the valve 57 opens, the operator is alerted that the lungs of the animal 209 are completely inflated and the operator will again depress the lever 129 to begin a power lung deflation cycle.

During any part of the power resuscitation process, the operator may, for one reason or another, wish to begin mouth-to-mouth resuscitation. If this is the case, the operator will release the lever 107 while depressing the lever 129, placing the valve in a configuration as shown in FIG. 7. No pressurized air or oxygen is admitted to the valve 11 from the tank 205 in this configuration but the valve 57 is forced open by the lever 129, overcoming the bias of the spring 45. The main valve housing 25 is then an open conduit which permits the operator to place his mouth on the exhaust port 55 and directly apply air from his own lungs to that of the animal 209 in a cyclic inflation and deflation process as is common with mouth-to-mouth resuscitation procedures.

The operator will also place the valve in the configuration of FIG. 7, by depressing the lever 129 while releasing the lever 107, to allow the animal 209 to breathe normally through the mask 201 and valve 11 after the animal 209 has begun breathing. Under these circumstances the operator will normally depress the valve 129 but will remove the mask 201 from the face of the animal 209 as quickly as possible.

While in FIG. 10 the valve 11 was shown attached to a resuscitation mask 201, it will be understood by those skilled in this art that any convenient apparatus may be used for attaching the valve 11 to the breathing passages of the animal 209. For example, a simple tube may be placed in the mouth of the animal 209, the other end of the tube being connected to the valve 11, while the nasal passages of the animal 209 are manually closed by the operator.

From the preceding description, it will be seen that an extremely efficient, very simple and portable resuscitation valve is formed by the valve of a present invention, the valve permitting power inflation as well as deflation of the lungs of the animal 209 as well as providing a relief valve to protect the animal 209 from injury. In addition, through the opening of the valve 57 and the sound made by the Coanda pump, the operator is visually or audibly notified when power inflation and power deflation of the lungs is complete so that the alternate cycle can be initiated. The valve also permits free breathing through the valve body or mouth-to-mouth resuscitation through the valve body as may be required.

What is claimed is:

1. A valve for use in combination with a source of gas under pressure and a buoyancy compensation vest by a diver, comprising:

a hollow cylindrical housing;

means fluidly connecting one end of said housing to said vest;

a cup-shaped member covering the other end of said housing, having a side vent, and mounted to telescope on said other end, said cup-shaped member closing said other end when telescoped to one extreme position and opening said other end to said side vent when telescoped away from said one extreme position;

a spring mounted within said cup-shaped member and surrounding said cylindrical housing, said spring biasing said cup-shaped member toward said one extreme telescoped position;

a lever mounted on said housing for manual actuation, said lever engaging said cup-shaped member to move said cup-shaped member away from said one extreme telescoped position;

a pressurized gas chamber mounted within said housing;

a manually actuatable valve connected to said source of gas and said pressurized gas chamber; and a narrow annular orifice connecting said pressurized gas chamber to the interior of said housing, said annular orifice centered at the axis of said cylindrical housing.

2. A valve as defined in claim 1 additionally comprising:

a conical surface adjacent said annular orifice, said surface directing gas from said orifice into said housing.

3. A valve as defined in claim 2 additionally comprising:

plural additional conical surfaces extending sequentially from said conical surface and inclined at different angles relative said annular orifice for directing said gas at plural directions within said housing.

4. A valve for use in combination with a source of pressurized gas and an inflatable chamber worn by a diver for adjusting his buoyancy, said valve comprising:

a housing connected to said chamber and including an exhaust opening;

manually actuated valving means, operable under water, for admitting gas from said source of pressurized gas in a first direction to said housing;

means operable under water for selectively altering the direction of said pressurized gas admitted in said first direction to direct the flow thereof in a second direction away from said exhaust opening to inflate said inflatable chamber;

means utilizing the kinetic energy of said gas admitted to said housing in said first direction through said valving means and operable under water for simultaneously exhausting gas from said chamber to said exhaust opening; and said valving means selectively inflating or deflating said chamber in accordance with the selective operation of said direction altering means.

5. A valve as defined in claim 4 wherein said means for exhausting gas entrains gas from said chamber in a stream of gas admitted from said source of said pressurized gas and directed toward said exhaust opening, said first direction being toward said exhaust opening.

6. A valve as defined in claim 5 wherein said means for exhausting directs the flow of gas admitted to said housing at a predetermined angle relative said housing.

7. A valve as defined in claim 6 wherein said means for exhausting gas directs the flow of said gas admitted to said housing utilizing the Coanda effect.

8. A valve as defined in claim 4 wherein said direction altering means comprises:

second manually actuated valving means for closing said exhaust opening, said second valving means directing gas admitted to said housing into said inflatable chamber.

9. A valve for use in combination with a source of pressurized gas and an inflatable chamber carried by a diver for adjusting his buoyancy, said valve comprising:

a housing connected to said chamber and including an exhaust opening;

first manually actuated valving means for admitting gas from said housing;

means utilizing the energy of gas admitted to said housing through said first valving means for simultaneously exhausting gas from said chamber to said exhaust opening; and second manually actuated valving means for closing said exhaust opening, said second valving means directing gas admitted to said housing into said inflatable chamber, said second valving means including an automatically operating pressure relief valve for protecting said chamber from overpressure.

10. A valve as defined in claim 9 wherein said first manually actuated valving means and said second manually actuated valving means are independently operable.

11. A valve for use in combination with a source of pressurized gas and an inflatable chamber carried by a diver for adjusting his buoyancy, said valve comprising:

a housing connected to said chamber and including an exhaust opening;

a manually actuated valve for admitting gas from said source of pressurized gas to said housing; and means utilizing the energy of gas admitted to said housing through said valve for exhausting gas from said chamber to said exhaust opening, said means exhausting gas from said chamber comprising:

means for admitting pressurized gas to said chamber through a narrow annular gap centered in said housing; and a conical surface adjacent said gap for Coanda adhesion of said gas, said conical surface admitting said gas to said housing along a conical path.

12. A valve assembly connected to a buoyancy compensation vest and regulated air pressure supply carried by a driver, said assembly comprising:

a housing;

a first manually actuated lever mounted on said housing;

means on said housing responsive to said first lever for venting said vest to the surrounding water;

a second manually actuated lever mounted on said housing; and means in said housing, operable under water, responsive to said second lever, and utilizing said air from said regulated supply for forcibly drawing air from said vest to said venting means when said venting means is open to said surrounding water, said means responsive to said second lever operable under water and utilizing said air from said regulated supply to forcibly inflate said vest when said venting means is closed.

13. A valve assembly as defined in claim 12 wherein said venting means comprises an opening in said housing fluidly connected to said vest and the water surrounding said diver and a valve responsive to said first lever for selectively closing said opening.

14. A valve assembly as defined in claim 12 wherein said means for drawing air comprises:

a valve connected to said regulated air pressure supply and said housing; and a surface within said housing for Coanda adhesion to air supplied through said valve.

15. A valve assembly as defined in claim 12 wherein said means for forcibly drawing air entrains air from said vest in said air from said regulated supply.

16. A buoyancy compensation device for use by a diver, comprising:

a source of pressurized gas;

an inflatable chamber worn by said diver; and transducer means, having an exhaust opening, and connected to said gas source and said chamber and operable under water for utilizing the kinetic energy of gas from said souce to selectively (a) provide a flow of combined gas from said source and said chamber in a first direction in said transducer means toward said exhaust opening to forcibly exhaust gas from said chamber, or (b) alter a flow of gas from said source from said first direction in said transducer means to a second direction in said transducer means away from said exhaust opening to inflate said chamber exclusively with gas from said source, said gas from said source being admitted to said transducer means exclusively in said first direction.

17. A buoyancy compensation apparatus as defined in claim 16 wherein said chamber is a buoyancy compensation vest worn by said diver.

18. A buoyancy compensation apparatus as defined in claim 16 wherein said transducer means utilizes a Coanda effect.

19. A buoyancy compensation apparatus as defined in claim 16 wherein said source of pressurized gas is a breathing air tank carried by said diver.

20. A buoyancy compensation apparatus as defined in claim 16 wherein said transducer means operates to exhaust more gas from said chamber than is utilized from said source.

21. A buoyancy compensation apparatus as defined in claim 16 wherein said transducer means entrains exhaust gas from said chamber in gas supplied from said source.

22. A valve for use in combination with a buoyancy compensation vest and breathing air tanks, both carried by a diver, for controlling the buoyancy of said diver, comprising:

a housing fluidly connecting to said vest, said housing including an exhaust port;

a valve closing said exhaust port;

means biasing said valve to a closed position against said exhaust port, said means permitting automatic opening of said valve in response to a predetermined pressure differential between the interior of said housing and its surroundings to prevent overpressurization of said vest;

an actuator for manually opening said valve;

a second valve for selectively admitting air from said breathing tank to said housing; and means directing flow of air from said breathing tank and said second valve into said housing to entrain air from said vest.

23. A valve for use in combination with a buoyancy compensation vest and breathing air tanks, both carried by a diver, for controlling the buoyancy of said diver, comprising:

a housing fluidly connected to said vest, said housing being an open-ended cylindrical member and said housing including an exhaust port;

a valve closing said exhaust port, said valve being a cup-shaped member having a side opening, said cup-shaped member telescoping over one end of said cylindrical housing;

means biasing said valve to a closed position against said exhaust port, said means permitting automatic opening of said valve in response to a predetermined pressure differential between the interior of said housing and its surroundings to prevent overpressurization of said vest;

and an actuator for manually opening said valve.

24. A valve as defined in claim 23 wherein said biasing means comprises a compression spring interposed between said cup-shaped member and said cylindrical housing, said spring biasing said cup for engagement against the end of said cylindrical housing.

25. A valve as defined in claim 24 wherein said actuator comprises a lever rotatably mounted on said housing, said lever when depressed bearing against said cup-shaped member to move said cup-shaped member away from the end of said cylindrical housing.

26. Apparatus for alternatively forcing a gas in two opposite directions through a conduit utilizing a source of pressurized gas for driving gas in each of said opposite directions, comprising:

a housing including a passage, said passage connected to one end of said conduit;

means for forcing gas through said conduit in a first direction, said means comprising:

a valve opening and closing said passage;

means for closing said valve; and means connected to said source of pressurized gas for exclusively admitting gas from said source in a second direction opposite said first direction at a location in said passage between said valve and said one end of said conduit; and means for forcing gas through said conduit in said second direction, said means comprising:

means for opening said valve; and means for entraining gas in said passage in gas admitted in said second direction by said gas admitting means to said passage from said source of pressurized gas to force said gas in said passage and said conduit in said second direction.

27. Apparatus for selectively forcing gas in two opposite directions in a conduit, comprising:

a source of pressurized gas;

first means mounted in said conduit, connected to said source of pressurized gas, admitting gas from said source to said conduit in a first direction and utilizing the Coanda effect for forcing gas in said first direction in said conduit; and second means, independent of said source of pressurized gas, for selectively blocking flow in said first direction in said conduit, said second means forcing said gas simultaneously admitted from said source to said conduit through said first means to reverse and flow in a second direction opposite said first direction.

28. A small, portable, hand-held respirator valve, comprising:

a main flow conduit;

means connecting said main flow conduit to a breathing passage of an animal;

a valve connected to a source of high pressure gas, said valve selectively admitting gas to said flow conduit in a first direction away from said connecting means to entrain air and exhaust the lungs of said animal; and means independent of said gas source for selectively blocking the flow of gas simultaneously admitted from said souce through said valve to reverse and flow in a second direction toward said connecting means.

29. A small, portable, hand-held respirator valve as defined in claim 28 additionally comprising:

pressure relief valve means on said main flow conduit for prohibiting pressures above a predetermined level in said flow conduit to prevent over-pressurization of the lungs of said animal.

30. A small, portable, hand-held respirator valve as defined in claim 28 additionally comprising:

a device connected to said valve for admitting said high pressure gas in a stream to said flow conduit to utilize the Coanda effect in entraining air and exhausting the lungs of said animal.

31. A small, portable, hand-held respirator valve as defined in claim 30 additionally comprising:

a surface adjacent said admitting device for Coanda adhesion of gas admitted from said valve.

32. A small, portable, hand-held respirator valve as defined in claim 28 wherein said means for selectively blocking comprises a pressure relief valve with a manual override.

33. A small, portable respirator valve, comprising:

a main housing having an exhaust opening;

a first conduit for communication between a breathing passage of an animal and said main housing;

a second conduit for communication between a source of pressurized gas and said main housing, said second conduit conducting gas from said source into said housing exclusively in a first direction away from said first conduit and toward said exhaust opening;

and means mounted on said housing for altering the direction of gas conducted into said housing in said first direction through said second conduit to alternately:

supply said first conduit exclusively with gas from said second conduit in a second direction away from said exhaust opening; or entrain gas from said first conduit in gas from said second conduit to drive gas from said first conduit out said exhaust opening.

* * * * *